US010563917B2

(12) United States Patent
Kawahara

(10) Patent No.: US 10,563,917 B2
(45) Date of Patent: Feb. 18, 2020

(54) HEATING DEVICE

(71) Applicant: TOYODA IRON WORKS CO., LTD., Toyota-shi, Aichi (JP)

(72) Inventor: Nobuyuki Kawahara, Toyota (JP)

(73) Assignee: TOYODA IRON WORKS CO., LTD., Toyota (JP)

( * ) Notice: Subject to any disclaimer, the term of this patent is extended or adjusted under 35 U.S.C. 154(b) by 66 days.

(21) Appl. No.: 15/768,673

(22) PCT Filed: Oct. 14, 2016

(86) PCT No.: PCT/JP2016/080479
§ 371 (c)(1),
(2) Date: Apr. 16, 2018

(87) PCT Pub. No.: WO2017/065253
PCT Pub. Date: Apr. 20, 2017

(65) Prior Publication Data

US 2018/0292135 A1 Oct. 11, 2018

(30) Foreign Application Priority Data

Oct. 15, 2015 (JP) ..... 2015-203651

(51) Int. Cl.
*F27D 5/00* (2006.01)
*C22C 38/50* (2006.01)
(Continued)

(52) U.S. Cl.
CPC ..... *F27D 5/00* (2013.01); *C21D 9/0025* (2013.01); *C22C 38/00* (2013.01); *C22C 38/002* (2013.01);
(Continued)

(58) Field of Classification Search
CPC ..... F27D 5/00
See application file for complete search history.

(56) References Cited

U.S. PATENT DOCUMENTS 2,805,942 A * 9/1957 Payson ..... C21D 9/46 420/57
3,179,393 A 4/1965 Bixby
(Continued)

FOREIGN PATENT DOCUMENTS

CN 2748547 Y 12/2005
CN 202539461 U 11/2012
(Continued)

OTHER PUBLICATIONS

Jan. 24, 2019 Office Action issued in Chinese Patent Application No. 201680059749.0.
(Continued)

*Primary Examiner* — Nathaniel Herzfeld
(74) *Attorney, Agent, or Firm* — Oliff PLC

(57) ABSTRACT

Embodiments include a heating device for heating a workpiece, including a furnace defining a closed space insulated from an exterior and surrounded by a heat insulator, a heater disposed in the furnace to heat a workpiece, a bar-shaped support element for supporting a workpiece in the furnace, and bases holding longitudinal ends of the support element for mounting the support element on a wall of the furnace, the support element being configured to increase the bending strength against sagging between its longitudinal ends.

7 Claims, 6 Drawing Sheets

(51) Int. Cl.

| | |
|---|---|
| ***F27B 17/00*** | (2006.01) |
| ***C22C 38/00*** | (2006.01) |
| ***F27B 5/06*** | (2006.01) |
| ***C21D 9/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| *C21D 1/673* | (2006.01) |

(52) U.S. Cl.

CPC ..... *C22C 38/02* (2013.01); *C22C 38/04* (2013.01); *C22C 38/06* (2013.01); *C22C 38/42* (2013.01); *C22C 38/50* (2013.01); *F27B 5/06* (2013.01); *F27B 17/00* (2013.01); *F27B 17/0016* (2013.01); *F27D 5/0006* (2013.01); *C21D 1/673* (2013.01); *F27D 2005/0081* (2013.01); *F27D 2005/0093* (2013.01)

(56) References Cited

U.S. PATENT DOCUMENTS

| | | | | |
|---|---|---|---|---|
| 6,402,507 | B1 * | 6/2002 | Boettger | F27B 9/10 432/236 |
| 2007/0257407 | A1 * | 11/2007 | Danger | C21D 9/46 266/249 |
| 2011/0117509 | A1 | 5/2011 | Claerbout et al. | |
| 2012/0315592 | A1 * | 12/2012 | Adelbert | C21D 9/46 432/239 |
| 2013/0216969 | A1 | 8/2013 | Schwartz | |
| 2014/0099085 | A1 | 4/2014 | Hayashi et al. | |

FOREIGN PATENT DOCUMENTS

| | | | |
|---|---|---|---|
| CN | 103299148 | A | 9/2013 |
| EP | 0 330 866 | A1 | 9/1989 |
| JP | S54-074211 | A | 6/1979 |
| JP | 2004-091894 | A | 3/2004 |
| JP | 2007-333272 | A | 12/2007 |
| JP | 2008-291284 | A | 12/2008 |
| JP | 2011-528428 | A | 11/2011 |
| JP | 2014-34689 | A | 2/2014 |
| JP | 2014-77565 | A | 5/2014 |
| KR | 10-0828526 BI | | 5/2008 |
| WO | 2014/072839 | A1 | 5/2014 |

OTHER PUBLICATIONS

Dec. 20, 2016 Search Report issued in International Patent Application No. PCT/JP2016/080479.

Feb. 12, 2019 Extended Search Report issued in European Patent Application No. 16 855 506.8.

* cited by examiner

HEATING DEVICE

FIELD OF THE INVENTION

The present invention relates to a heating device used in hot press processes.

DESCRIPTION OF THE RELATED ART

Known methods of manufacturing high strength pressed parts of a vehicle include hot pressing. In a hot pressing process, a high tensile steel sheet may be heated to a temperature of about 900° C., and then simultaneously press formed and rapidly cooled between pressing dies of a low temperature to produce a quenched product (see Japanese Patent Application Publication No. 2008-291284).

In general, the hot pressing include continuously heating a number of steel sheets in a furnace for improving the thermal efficiency.

SUMMARY OF THE INVENTION

However, the continuous heating exposes components of the furnace to the high temperature for a long time, which may cause components with low heat resistance to deform by creep. When the support elements that support a steel sheet or other workpiece in a furnace creep under the load of the workpiece to deform into a curved shape, various problems arise. For example, when a heated workpiece is taken off from the support elements by a transfer device, the height at which the workpiece is supported is lowered by the deformation of the support elements, so that the fork of the transfer device interferes with the lower surface of the workpiece.

There is thus a need to increase the bending strength of the support elements that support workpieces in the furnace of a heating device to prevent creep deformation of the support elements when the support elements are exposed to the high temperature for a long time in the furnace.

The present invention in one aspect provides a heating device for heating a workpiece, comprising a furnace defining a closed space insulated from an exterior and surrounded by a heat insulator, a heater disposed in the furnace to heat a workpiece, a bar-shaped support element for supporting a workpiece in the furnace, and bases holding longitudinal ends of the support element for mounting the support element on a wall of the furnace, the support element being configured to increase the bending strength against sagging between its longitudinal ends. In some embodiments, this prevents deformation when the support element is exposed to the high temperature for a long time in the furnace to become susceptible to deformation.

In one embodiment, the support element may have a shape of a rectangular tube, the rectangular tube having a double bottom. In some embodiments, this increases the bending strength of the support element with respect to the sagging between its longitudinal ends, and prevents deformation when the support element is exposed to the high temperature for a long time in the furnace to become susceptible to deformation.

In another embodiment, the support element may comprise two upper and lower rectangular tube members integrally joined together. The support element thus comprise a rectangular tube having a double bottom, which in some embodiments increases the bending strength against sagging between its longitudinal ends, and prevents deformation when the support element is exposed to the high temperature for a long time in the furnace to become susceptible to deformation.

In yet another embodiment, the support element may comprise a rectangular tube member, and a U-section reinforcement member joined to the rectangular tube member along the lower lateral surface of the rectangular tube member, the bottom of the rectangular tube member being spaced from the bottom of the reinforcement member by a predetermined gap. The rectangular tube member thus has a double bottom, which in some embodiments increases the bending strength of the support element against the sagging between the longitudinal ends, and prevents deformation when the support element is exposed to the high temperature for a long time in a furnace to become susceptible to deformation.

In yet another embodiment, the support element may comprise a rectangular tube comprising two opposing U-section sheet steel members integrally joined to form a closed cross section. In some embodiments, this increases the bending strength against sagging between its longitudinal ends, and prevents deformation when the support element is exposed to the high temperature for a long time in the furnace to become susceptible to deformation.

In yet another embodiment, the support element may be made of an austenitic nickel-iron-chromium solid solution alloy, preferably comprising, in percent by weight, 30 to 32% nickel, 19 to 22% chromium, 0.06 to 0.1% carbon, 0.5 to 1.5% manganese, 0.2 to 0.7% silicon, up to 0.015% phosphorus, up to 0.01% sulfur, up to 0.5% copper, 0.3 to 0.6% aluminum, and 0.3 to 0.6% titanium, wherein aluminum and titanium together are up to 1.2%, the remainder being iron. The support element made of the material specified above increases the bending strength of the support element against sagging between the longitudinal ends. This prevents deformation when the support element is exposed to the high temperature for a long time in the furnace to become susceptible to deformation.

DETAILED DESCRIPTION OF THE INVENTION

FIGS. 1 to 5 show a heating device including a furnace for use in a hot press method in one embodiment of the present invention. Directions with respect to the heating device as installed on a base plate is indicated in each figure with arrow signs. In the following, the directional descriptions will be made with reference to these directions. When specifying directions, the inlet side may also be referred to as "front" and the outlet side as "rear" for convenience of description.

Figure 1:
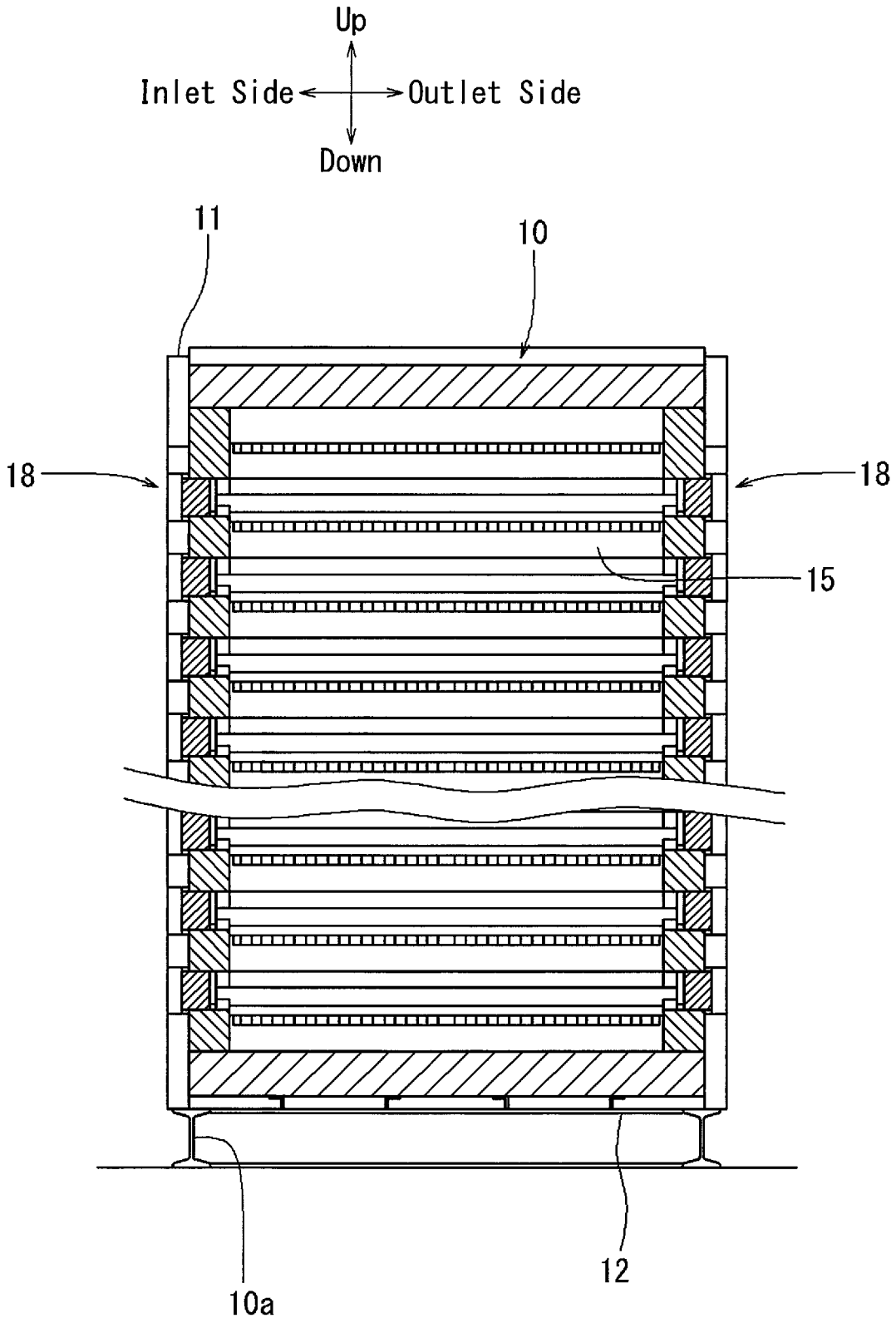
FIG. 1 is a side sectional view of a heating device including a multi-stage furnace according to one embodiment of the present invention.
Figure 2:
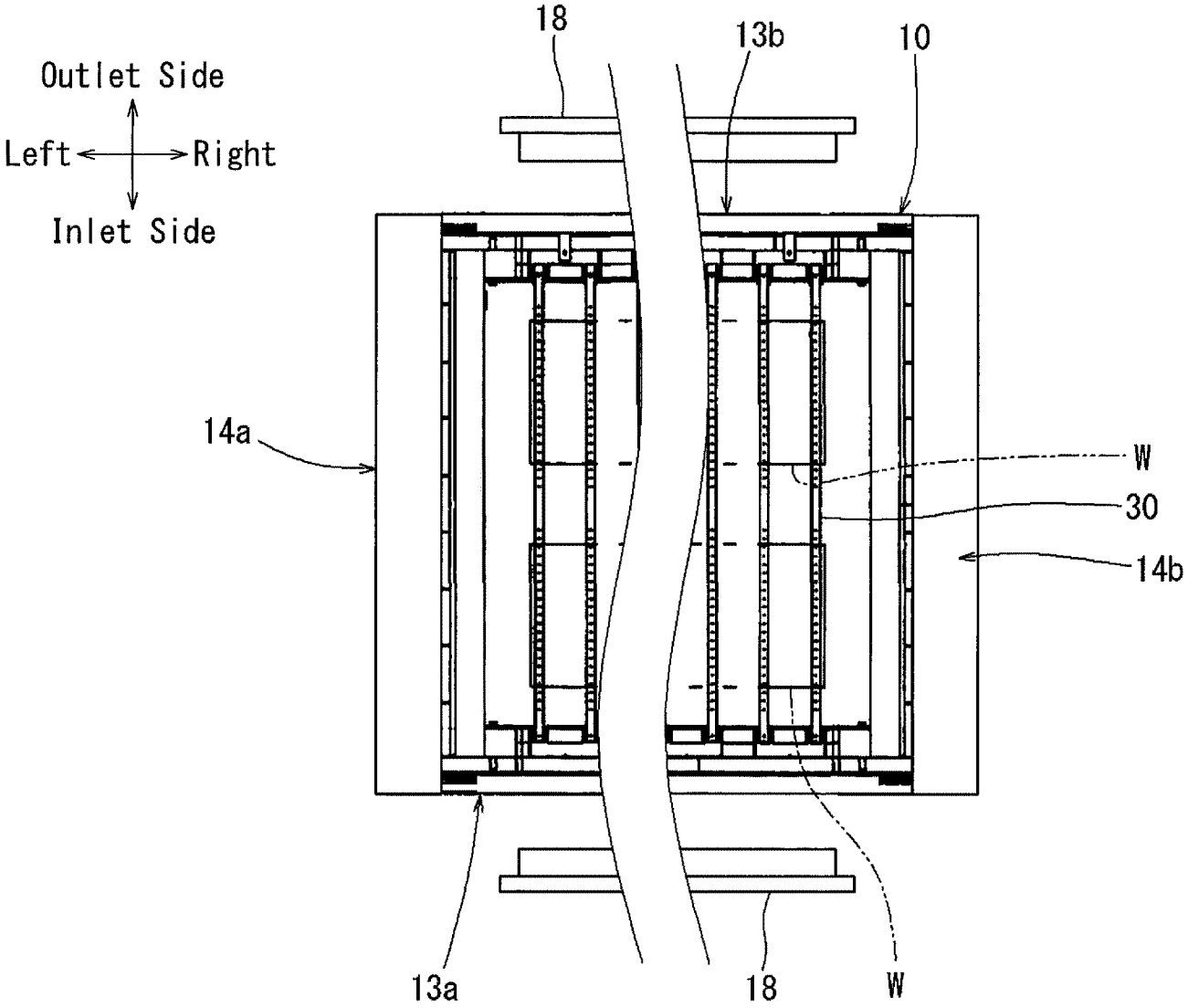
FIG. 2 is a plan sectional view of the heating device of FIG. 1.

As shown in FIGS. 1 and 2, the furnace 10 comprises an integrated stack of a plurality of single-stage units between a top frame 11 and a bottom frame 12. The furnace 10 may accommodate as many sets of workpieces W vertically as the single-stage units, each set including two placed in front and rear positions, and can heat them at the same time. The number of single-stage units to be stacked is determined by the number of workpieces W to be accommodated vertically, and the width and depth dimensions of the furnace 10 is determined by the number and size of workpieces W to be accommodated from the front to the rear. Under the bottom frame 12 there may be a support frame 10*a* by which the furnace 10 is supported on the base plate.

Each single-stage unit may comprise a box-shaped combination of an inlet side plate 13*a*, an outlet side plate 13*b*, a left side frame 14*a* and a right side frame 14*b*, and an arrangement of heater supporting plates 15 each extending from the front to the rear between the inlet side plate 13*a* and the outlet side plate 13*b*. In FIG. 2, the heater supporting plate 15 is hidden below the support elements 30 which support the workpieces W.

Figure 3:
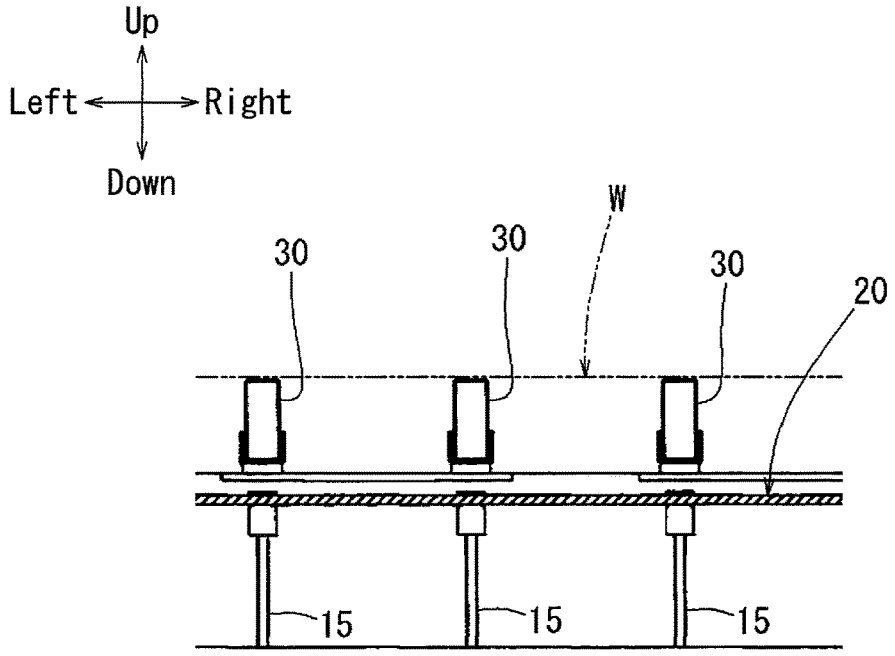
FIG. 3 is an enlarged front view of support elements and a heater of a workpiece in the heating device of FIG. 1.

As shown in FIG. 3, a planar heater 20 is placed over the heater supporting plates 15. The interface between the heater supporting plate 15 and the heater 20 is electrically insulated. The heater 20 may be an electric coil heater, a radiant tube or any other heater, powered via the left side frame 14*a* and right side frame 14*b*.

Figure 4:
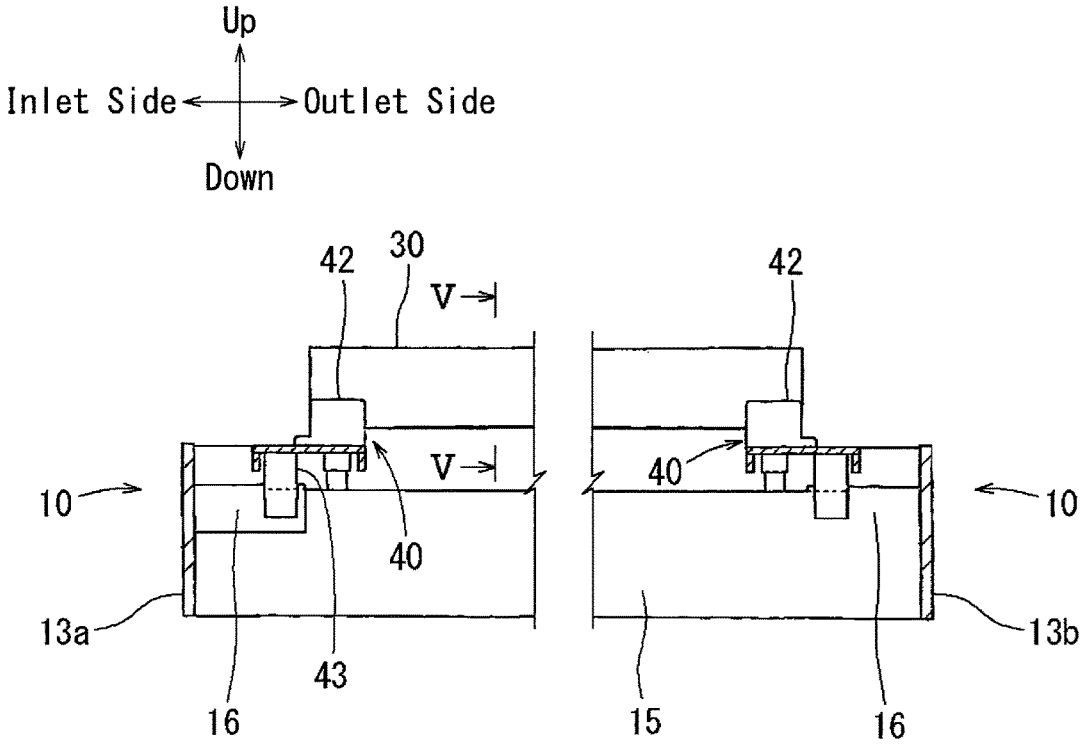
FIG. 4 is an enlarged side view around bases on the inlet and outlet sides of the heating device of FIG. 1.

As shown in FIGS. 3 and 4, in order to support workpieces W, a plurality of support elements 30, which may be bars of a heat-resistant metal (e.g. SUS310S), oriented front to rear, are arranged from left to right, each positioned above the respective heater supporting plate 15.

Each support element 30 may be a rectangular tube and extends between the inlet side plate 13*a* and the outlet side plate 13*b*, similarly to the heater supporting plates 15. More specifically, as shown in FIG. 4, each support element 30 is mounted at its ends to the inlet side plate 13*a* and outlet side plate 13*b* via bases 40 and edge plates 16. The base 40 holds the support elements 30 by support element retaining portions 42 while being supported on the edge plate 16 by a columnar portion 43. The inlet and outlet side plates 13*a* and 13*b* are equivalent to walls of the furnace in the present disclosure.

Figure 5:
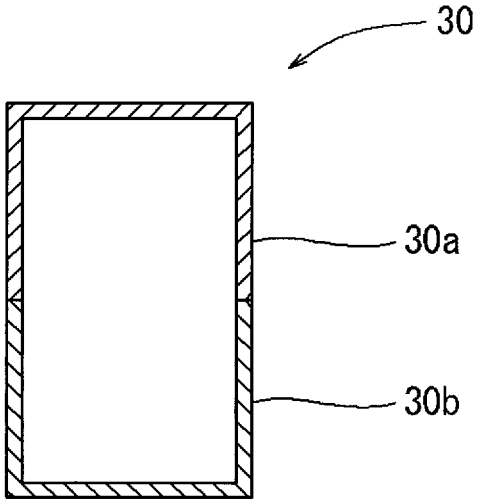
FIG. 5 is an enlarged cross-sectional view of the heating device of FIG. 4 taken along line V-V.

FIG. 5 shows the cross-sectional shape of the support element 30. The support element 30 comprises a rectangular tube comprising two opposing sheet steel members 30*a* and 30*b* having a U-shaped cross section welded together to form a closed cross section. A common support element would comprise a rectangular tube comprising a combination of two sheet steel members each having an L-shaped cross section, with each L-section sheet steel member constituting a vertical and a horizontal side of the rectangular tube. Compared with such a common support element, the support element 30 in the embodiment described herein has a higher rigidity and thus a higher bending strength against sagging between its longitudinal ends. This prevents deformation of the support element 30 when the support element 30 is exposed to the high temperature for a long time in the furnace to become susceptible to deformation.

Figure 6:
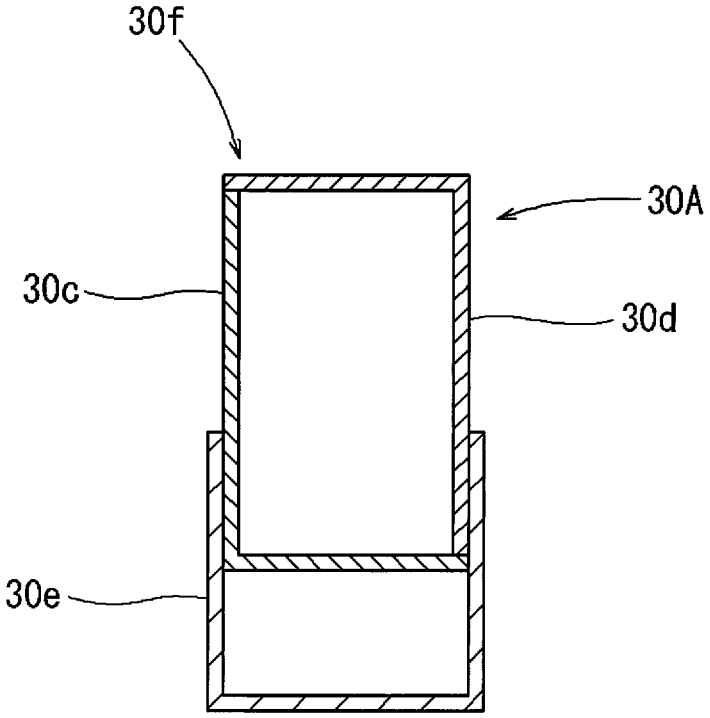
FIG. 6 is a cross-sectional view corresponding to FIG. 5 of a heating device according to another embodiment of the present invention.

FIG. 6 shows a cross-sectional shape of a support element 30A in another embodiment of the present invention. While the support element 30A is used here instead of the support element 30 in the embodiment described above, the other features of the heating device may be the same as the embodiment described above. The support element 30A comprises a rectangular tube member 30*f* comprising a combination of two sheet steel members (for example, SUS310S) 30*c* and 30*d* each with an L-shaped cross section, and a reinforcement member 30*e* with a U-shaped cross section welded to the rectangular tube member 30*f* so as to cover the lower side of the rectangular tube member 30*f*. The bottom surface of the rectangular tube member 30*f* is spaced from the bottom of the reinforcement member 30*e* by a predetermined gap.

The support element 30A thus has the rectangular tube member 30*f*, which is similar to a common support element, covered by the reinforcement member 30*e* on the bottom, resulting in the rectangular tube having a double bottom. Therefore the support element 30A has a higher rigidity and a higher bending strength against sagging between its longitudinal ends. This prevents deformation of the support element 30 when the support element 30 is exposed to the high temperature for a long time in the furnace to become susceptible to deformation.

In another embodiment, the rectangular tube member 30*f* may be provided with a double bottom by welding the U-section reinforcement member 30*e* to the rectangular tube member 30*f* with its open end faces butted against the bottom surface of the rectangular tube member 30*f*, instead of the U-section reinforcement member 30*e* covering the lower side of the rectangular tube member 30*f* as described above.

Figure 7:
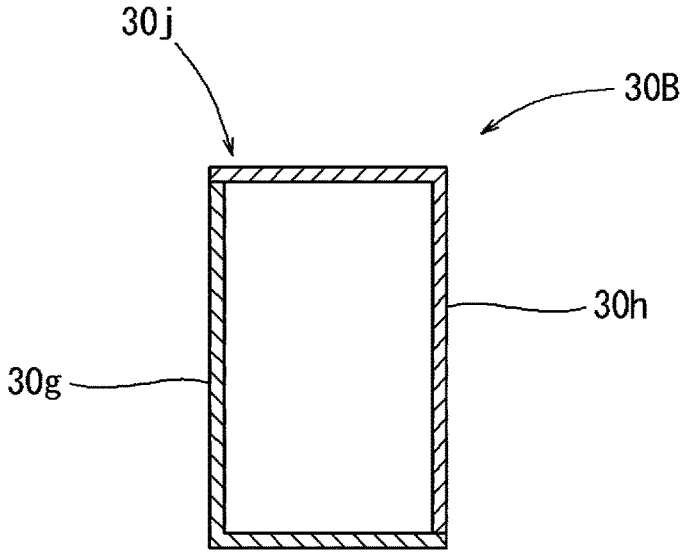
FIG. 7 is a cross-sectional view corresponding to FIG. 5 of a heating device according to still another embodiment of the present invention.
Figure 9:
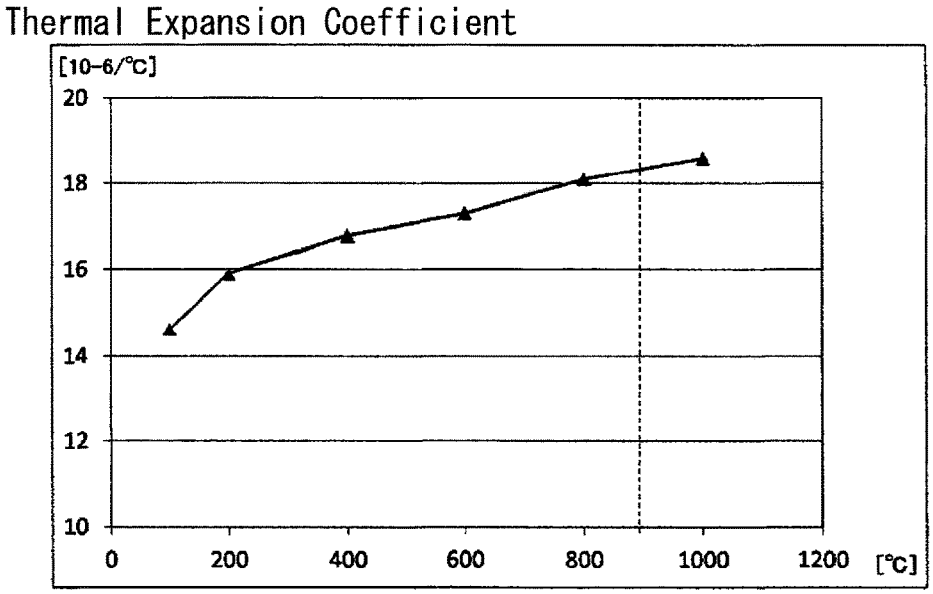
FIG. 9 is a chart showing a thermal expansion characteristics of the support element of FIG. 7.
Figure 10:
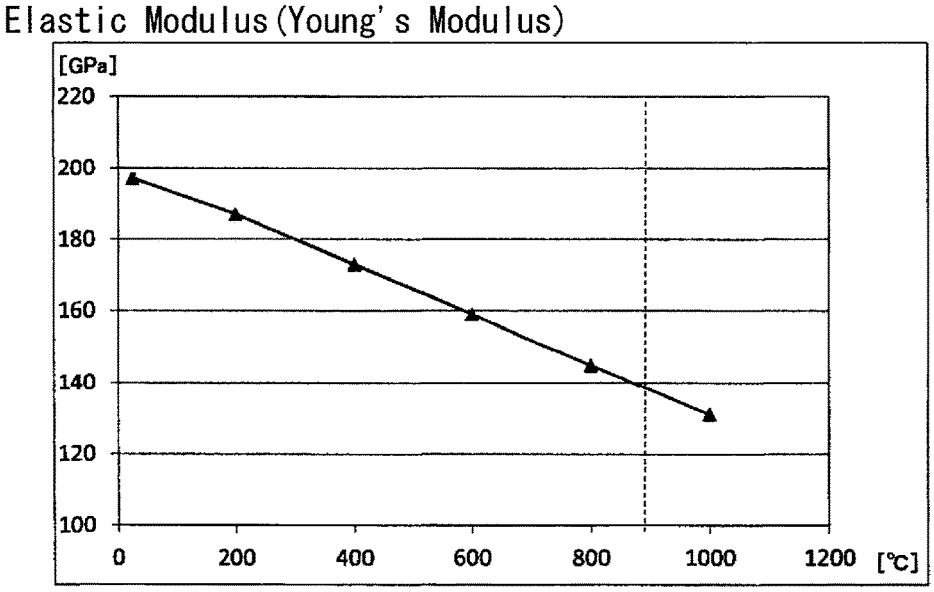
FIG. 10 is a chart showing elastic modulus characteristics of the support element of FIG. 7.

FIG. 7 shows a cross-sectional shape of the support element 30B in still another embodiment of the present invention. While the support element 30B is used here instead of the support element 30 in the embodiment described above, the other features of the heating device may be the same as the embodiments described above. The support element 30B comprises a rectangular tube 30*j* comprising a combination of two sheet metal members 30*g* and 30*h* each with an L-shaped cross section. The sheet metal members 30*g* and 30*h* are made of an austenitic nickel-iron-chromium solid solution alloy, preferably including, in percent by weight, 30 to 32% nickel, 19 to 22% chromium, 0.06 to 0.1% carbon, 0.5 to 1.5% manganese, 0.2 to 0.7% silicon, up to 0.015% phosphorus, up to 0.01% sulfur, up to 0.5% copper, 0.3 to 0.6% aluminum, and 0.3 to 0.6% titanium, wherein aluminum and titanium together are up to 1.2%, the remainder being iron. The sheet metal members 30*g* and 30*h* may be made of Incoloy® 800HT for example. Incoloy® 800HT has a high strength at high temperature and can increase the bending strength of the support element 30B against sagging between the longitudinal ends. This prevents creep deformation when the support element 30B is exposed to the high temperature for a long time in the furnace. FIGS. 9 and 10 show the thermal expansion and elasticity characteristics of Incoloy® 800HT. In FIGS. 9 and 10, the dashed lines indicate the level of temperature (900° C.) to which the material is exposed when it is used for the support element of the heating device of the present invention.

Figure 8:
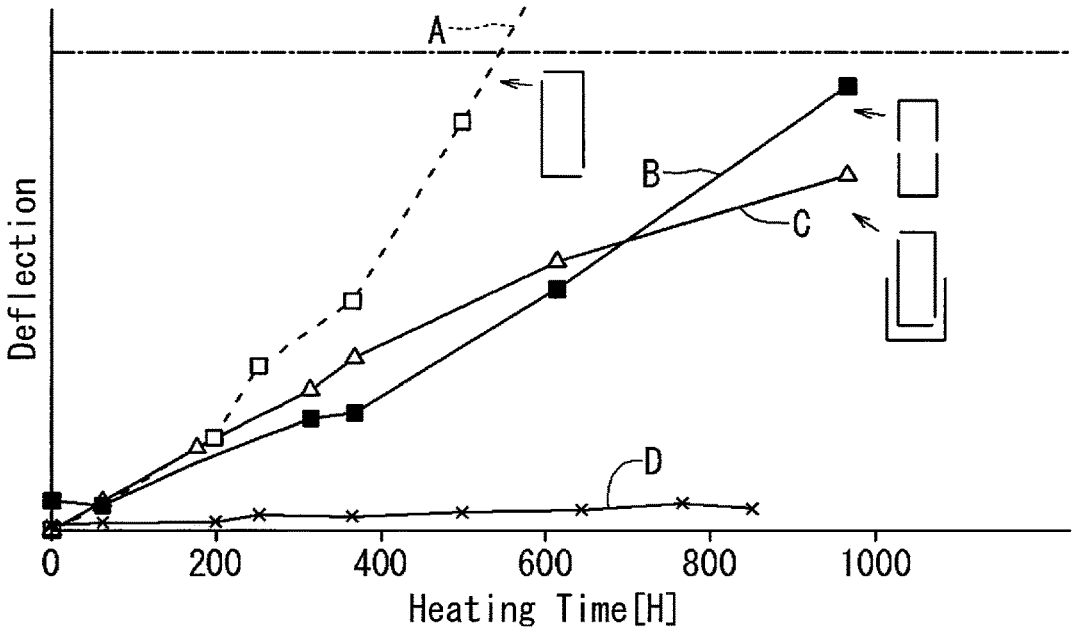
FIG. 8 is a chart showing deflection characteristics of the support element in each of the embodiments of FIGS. 5, 6 and 7.

FIG. 8 shows the deflection characteristics of the three types of support elements 30, 30A and 30B described above at high temperatures. This chart summarizes the results of measuring the deflection of the support elements 30, 30A and 30B at regular intervals in the heating time while the inside of the furnace 10 was maintained at 900° C. According to FIG. 8, the common support element made of SUS310S results in a deflection exceeding the allowable deflection (indicated in a dot-dashed line) when the heating time is 500 to 600 hours as shown by graph A. In contrast, the support element 30 and the support element 30A described above with reference to FIGS. 5 and 6 result in a deflection smaller than the allowable deflection even when the heating time is approaching 1000 hours as shown by graphs B and C, respectively. In addition, the support element 30B described above with reference to FIG. 7 results in a deflection extremely small and bends little even when the heating time is about 900 hours as shown by graph D.

Accordingly, the heating devices in embodiments using the support element 30 and the support element 30A can reduce the frequency of replacing support elements to about a half as compared with the case of using common support elements. This means that the maintenance cost is suppressed to about a half. The heating devices in embodiments using the support element 30B hardly require replacement of the support elements.

As shown as hatched areas in FIG. 1, heat insulators are disposed around each single-stage unit, on the lower surface of the top frame 11 and on the upper surface of the bottom frame 12. The furnace is surrounded by heat insulators 10 to have a closed space insulated from the exterior.

As shown in FIGS. 1 and 2, each single-stage unit has a shutter 18 on each of the inlet and outlet sides for opening and closing the furnace 10 with respect to the exterior; the shutters are situated between the single-stage units, between the top frame 11 and the single-stage units, and between the bottom frame 12 and the single-stage units. Specifically, the shutters 18 on each single-stage unit are configured to be vertically opened and closed with respect to the left side frame 14*a* and the right side frame 14*b*. A heat insulator is also disposed on the inner surface of the shutter 18.

In use of the heating device described above in a hot pressing process, the heater 20 is energized to generate heat, the shutters 18 on the inlet side are sequentially opened, a workpiece W is transferred into each single-stage unit, as shown in FIGS. 2 and 3, and then the shutters 18 are closed. When the workpiece W on the support elements 30 has been heated to a predetermined temperature of about 900° C. by the heater 20, the shutters 18 on the outlet side are sequentially opened, and the workpiece W is taken off from the support elements 30 in each single-stage unit. In the next step, the extracted workpiece W is simultaneously press formed and quenched.

While specific embodiments of the present invention have been described above, the embodiments of the present invention are not limited to the appearances and configurations shown in the above description and the drawings, and those skilled in the art will appreciate that various modifications, additions and deletions.

The invention claimed is:

1. A heating device for heating a workpiece, comprising:

a furnace defining a closed space insulated from an exterior and surrounded by a heat insulator;

a heater disposed in the furnace to heat a workpiece;

a replaceable bar-shaped support element for supporting a workpiece in the furnace, the support element comprising a rectangular tube comprising a combination of two sheet metal members each having an L-shaped cross section; and bases holding longitudinal ends of the support element for mounting the support element on a wall of the furnace, each base having a support element retaining portion, the support element being replaceable held by the support element retaining portion the support element being configured to increase the bending strength against sagging between its longitudinal ends.

2. The heating device of claim 1, the support element comprising a rectangular tube comprising two opposing U-section sheet steel members integrally joined to form a closed cross section.

3. The heating device of claim 1, the support element being made of an austenitic nickel-iron-chromium solid solution alloy.

4. The heating device of claim 3, the nickel-iron-chromium solid solution alloy comprising, in percent by weight, 30 to 32% nickel, 19 to 22% chromium, 0.06 to 0.1% carbon, 0.5 to 1.5% manganese, 0.2 to 0.7% silicon, up to 0.015% phosphorus, up to 0.01% sulfur, up to 0.5% copper, 0.3 to 0.6% aluminum, and 0.3 to 0.6% titanium, wherein aluminum and titanium together are up to 1.2%, the remainder being iron.

5. The heating device of claim 1, wherein the support element retaining portion is configured to have a U-shaped cross section to hold the support element.

6. The heating device of claim 1, wherein the replaceable support element is symmetrically configured so that the support element can be used upside down.

7. A heating device for heating a workpiece, comprising:

a furnace defining a closed space insulated from an exterior and surrounded by a heat insulator;

a heater disposed in the furnace to heat a workpiece;

a bar-shaped support element for supporting a workpiece in the furnace; and bases holding longitudinal ends of the support element for mounting the support element on a wall of the furnace, the support element being configured to increase the bending strength against sagging between its longitudinal ends, the support element comprising:

a rectangular tube member; and a U-section reinforcement member joined to the rectangular tube member along the lower lateral surface of the rectangular tube member;

the bottom of the rectangular tube member being spaced from the bottom of the reinforcement member by a predetermined gap.

* * * * *